US006644698B1

(12) United States Patent
Christensen

(10) Patent No.: US 6,644,698 B1
(45) Date of Patent: Nov. 11, 2003

(54) FOLDING DOOR BAR LOCK

(76) Inventor: Scott E. Christensen, 9970 River View Cir., Stockton, CA (US) 95209

( * ) Notice: Subject to any disclaimer, the term of this patent is extended or adjusted under 35 U.S.C. 154(b) by 0 days.

(21) Appl. No.: 10/218,327

(22) Filed: Aug. 12, 2002

Related U.S. Application Data

(60) Provisional application No. 60/376,529, filed on Apr. 30, 2002.

(51) Int. Cl.[7] ..... E05C 19/18

(52) U.S. Cl. ..... 292/259 R; 292/289; 292/288; 292/338; 292/339; 292/291; 292/DIG. 46

(58) Field of Search ..... 292/259 R, 260, 292/289, DIG. 46, 288, 338, 339, 291, DIG. 2, 258

(56) References Cited

U.S. PATENT DOCUMENTS

| | | | | | |
|---|---|---|---|---|---|
| 109,330 | A | * | 11/1870 | Maddox | 292/256.5 |
| 2,130,216 | A | * | 9/1938 | Zaninovich | 292/259 R |
| 3,677,592 | A | * | 7/1972 | Navara | 292/288 |
| 3,826,115 | A | * | 7/1974 | Davis | 70/258 |
| 4,067,598 | A | * | 1/1978 | Mansour | 292/259 R |
| 4,330,147 | A | * | 5/1982 | Nolen | 292/259 R |
| 4,856,831 | A | * | 8/1989 | Roden, Jr. | 292/259 R |
| 5,340,172 | A | * | 8/1994 | Sweet | 292/259 R |
| 5,350,070 | A | * | 9/1994 | Stamatopoulos et al. | 211/64 |
| 5,419,165 | A | * | 5/1995 | Perkins | 70/14 |
| 5,458,432 | A | * | 10/1995 | Teschner et al. | 403/374.3 |
| 5,496,081 | A | * | 3/1996 | Rice | 292/259 R |
| 5,501,086 | A | * | 3/1996 | Sherlock | 70/58 |
| 5,573,290 | A | * | 11/1996 | Smith | 292/338 |
| 5,605,364 | A | * | 2/1997 | Shelledy | 292/259 R |
| 5,826,923 | A | * | 10/1998 | Bethurem | 292/259 R |
| 6,018,968 | A | * | 2/2000 | Sides | 70/14 |
| 6,032,498 | A | * | 3/2000 | Sherlock et al. | 70/58 |
| 6,352,290 | B1 | * | 3/2002 | Scottino | 292/259 R |

* cited by examiner

*Primary Examiner*—Robert J. Sandy
*Assistant Examiner*—Thomas Ho
(74) *Attorney, Agent, or Firm*—Donald W. Mecker

(57) ABSTRACT

A bar lock having two interconnected aluminum bars for engaging handles on folding doors, and preferably extending across all the seams in the folding doors to prevent the simultaneous outward and lateral opening motion of the doors. Clamping the horizontal door handles on folding fireplace doors bars children from opening the doors.

4 Claims, 2 Drawing Sheets

FOLDING DOOR BAR LOCK

CLAIM OF PROVISIONAL APPLICATION RIGHTS

This application claims the benefit of U.S. Provisional Patent Application No. 60/376,529, filed on Apr. 30, 2002.

BACKGROUND OF THE INVENTION

1. Field of the Invention

The present invention relates to locks for folding doors and, in particular, to a bar lock having two interconnected steel bars for engaging handles on folding doors and extending across the folding doors to prevent the simultaneous outward and lateral opening movement of the doors to bar children from being able to open them, especially applicable to folding fireplace doors.

2. Description of the Prior Art

Folding doors are used for many purposes such as fireplace doors, closet doors, appliance area doors, and other applications employing folding doors. The use of glass fireplace doors has become relatively common. These generally take the form of two pairs of folding doors for a total of four glass panels with a relatively flimsy frame thereabout and a damper at the bottom to allow air from inside the house to feed the fire for combustion purposes when the doors are closed.

Young children opening and closing folding doors can often get their fingers caught in the door seams if any pressure is exerted on any part of the door while the child's fingers or hand is present in the seam, causing pain and injuries. Furthermore, it is often desirable to limit young children's access to certain areas enclosed by folding doors to prevent injury to the children or any disturbance or damage to whatever is enclosed by the doors. Children playing in fireplaces is especially undesirable since they may be injured by the folding doors, by hot embers, by grates or logs, the ingestion of ashes or creation of messes to clean up from the ashes.

Several prior art attempts have been made to solve the problem of barring locking or securing folding doors, but none have provided a simple inexpensive retrofit means for securing folding doors.

U.S. Pat. No. 4,971,032, issued Nov. 20, 1990 to Gardner, provides a fireplace shield held in either its first position, that is, in its extended position or its second position, that is, its storage position or folded position by means of a locking bar. In the preferred, the locking bar comprises an elongated U-shaped channel which is of sufficient length to engage all four of the panels when in their extended or first position. The U-shaped locking bar is formed of a material which is flexible in nature, such as spring steel or the like, so that the legs of the U-shaped locking bar can clamp the four panels when in their first extended position and may be readily resiliently expanded to lock the four panels together when the panels are in their folded position. Thus, the locking bar is capable of firmly holding the fireplace shield in either its operative position wherein the panels are extended in a side by side relationship or in its storage position wherein the panels lie one on the other.

U.S. Pat. No. 5,188,091, issued Feb. 23, 1993 to Gardner, shows a fireplace enclosure comprising a plurality of glass panels and a plurality of screen panels, with the screen panels being positioned exteriorly of the glass panels. The glass panels are maintained within a frame which is integrally connected to the screen panels. At least one of the screen panels is pivotable to an open position, which permits access to the glass doors, and into the fireplace. The glass doors are also movable relative to the frame, to permit access to the fireplace. A latching mechanism maintains the screen panels in a closed position, which prevents ready access to the fireplace. A removable arch plate is releasably secured to the interior of the frame for the glass panels, and provides a decorative arch, which is seen through the glass panels.

U.S. Pat. No. 4,787,365, issued Nov. 29, 1988 to Coleman, claims a double walled fireplace insert shown with an inner firebox and an outer shell to provide convection air channels between the parallel walls of the inner and outer units. A front panel is integral with the outer shell, and it covers the front of the insert. This front panel has room air intake vents that open into the said air channels, and warmed air outlet vents that open into the room to be heated by this fireplace. There is a circulating fan positioned within the convection air channels for governing the air movement through the said channels. Each of the rear walls of the insert has a pivoted heavy metal door to accommodate the rear loading of the interior firebox when there is a vertical masonry chimney built on the outside of the residence over the fireplace insert installed through the outer wall with a door opening in the lower portion thereof for gaining access to the two rear doors of the fireplace insert so that firewood may be loaded from the outside into the firebox through the open rear doors, and ashes and cinders may be collected and removed through these two rear door openings from the outside after the fire has subsided. A lock mechanism is provided for the outer rear door to prevent unauthorized entry by unknown persons.

U.S. Pat No. 6,386,194, issued May 14, 2002 to Christman, describes a masonry fireplace and a masonry fireplace log box fitted with a door (interior or exterior) or doors (both interior and exterior) that permits firewood to be loaded into the log box without need to carry wood through the interior of the home. Many masonry fireplaces that are constructed in new homes include a built-in log box (or firewood box) as part of the masonry structure. The log box consists of a recessed chamber with sufficient depth to allow a supply of firewood to be stored convenient to the fireplace without need to stack the wood on the hearth or the floor near the fireplace (or stove insert). With the present invention, the firewood is stocked into the log box from the exterior of the home and removed as needed from the interior opening of the log box. In the case of the single interior or exterior door, the door is insulated for energy efficiency and fitted with a locking mechanism to prevent entry by an intruder. For the case where both interior and exterior doors are provided, one door would be insulated and that door or the other would be provided with a locking mechanism. Hinge locations and bolts that attach the door(s) to the masonry structure are also designed to prevent intruder entry. A second embodiment is disclosed wherein the fireplace and the log box are non-masonry, pre-assembled units providing the same advantages as the masonry embodiment.

U.S. Pat. No. 4,219,005, issued Aug. 26, 1980 to Boahn, discloses an improved fireplace heat exchanger in the form of an integral heat exchange system, fireplace closure, air tight glass doors and an outside air introduction system. The unit is built as a single unit and is installed as such either in new construction or preexisting fireplaces. The invention also includes a unique door locking system to assure air tight integrity between the interior of the house and the fire in the fireplace.

U.S. Pat. No. 4,508,098, issued Apr. 2, 1985 to Scheler, indicates a fireplace cap including a pair of hinged doors supported by a rectangular framework of first and second side rails, a header section, and a damper section. The components forming the framework are formed with flanges positioned at the rear of the cap for reinforcing purposes and to act as heat exchangers, picking up heat from a fire within the fire box of the fireplace. This cap can be easily custom fit to fireplaces having fire boxes of various sizes by selecting appropriate components for the framework. A top piece mounted to the header section may serve as a cooking surface. The doors may include optional glass plates supported for easy removal by angle members mounted to the back side of the doors. A latching mechanism, including eccentrically mounted latching arms, holds the doors tightly closed when latched. The top piece and side rails define sealing material receiving pockets and include retainers for holding sealing material to seal the cap against the front of the fireplace. Adjustable damper controls, together with an external lever actuated control for the existing damper of the fireplace, are utilized to control the flow of combustion air into the fire box. A removable key or handle is provided for the latching mechanism so that it may be stored in a cool location or out of the reach of children for safety purposes.

U.S. Pat. No. 4,213,446, issued Jul. 22, 1980 to Stookey, puts forth a stove for burning combustible materials having a fire box at least in part lined with a fire resistant lining and having an opening across a front surface thereof, said opening defined by a hearth and an upper lip and equipped with pivotally mounted door means mounted for rotation within the stove along horizontally disposed axes so that the opening can be effectively closed by rotation of the upper and lower doors into their closed position. The hearth may be equipped with an upstanding transparent panel to permit viewing of the fire when the doors are open. Access to the fire box for insertion of additional flammable materials is provided by a door means positioned at the end of said fire box. Protection for the transparent panel to prevent logs from rolling against it may be provided by elongated means extending across the front opening at or above the rearward portion of the hearth.

U.S. Pat. No. 4,029,076, issued Jun. 14, 1977 to Simington, concerns a bay window-type of metal enclosure is provided for the opening of a fireplace including a hearth extending outwardly beyond the lower portion of the fireplace opening. The enclosure includes a downwardly opening U-shaped frame for abutting the marginal portions of the front wall of the fireplace surrounding the opening, a horizontally outwardly projecting top wall supported from the upper horizontal portions of the U shaped frame and a lower partial front wall projecting outwardly from and extending between the lower ends of the legs of the U-shaped frame, the opposite side marginal portions of the top wall and the opposite ends of the partial front wall being inwardly divergent and the outer marginal portion of the top wall and the central portion of the partial front wall generally paralleling the front wall of the fireplace through which the fireplace opens. Horizontally swingable opposite side and partial front wall door assemblies each including a pair of relatively swingable doors are provided and each door assembly has one door thereof pivotally supported from the corresponding leg of the U-shaped frame for swinging about a horizontal axis and the other door of each door assembly is swingable relative to the first door about a vertical axis. The door assemblies may be swung to closed positions in closing those open portions of the bay window-type enclosure extending between the low partial front wall and the top wall thereof and open positions swung outwardly of remote sides of the legs of the U-shaped frame, the free swinging edge portions of the door assemblies including upper latching structure with which further latching structure carried by the center portion of the top wall of the enclosure may coact to retain the door assemblies in the closed positions, the doors of the door assemblies each including large openings formed therein close by means of transparent panels, the center portion of the low partial front wall including a damper controlled draft air inlet and the top wall including a shiftable damper control for operative association with the existing damper in the flue of the associated fireplace.

No prior art patents have a simple double bar bolting locking means for existing folding and other types of fireplace doors.

SUMMARY OF THE INVENTION

An object of the present invention is to keep children safe and out of the fireplace by preventing them from opening fireplace doors or other doors that fold or swing. By locking the fireplace doors, children are protected from the hazards associated with fireplace folding doors and interiors.

Another object of the present invention is that it provides a device for childproofing a home adaptable to any folding doorway, such as fireplace doors, to keep children out of places where they should not be, including appliance areas such as those for a washer and dryer, located behind folding doors.

A related object of the present invention is that it provides a rigid means of preventing movement of folding doors and thereby helps prevent children's hands and fingers from getting pinched in folding doors.

One more object of the present invention is to reduce the possibility of injuries associated with fireplace interiors such as those by hot embers, by grates or logs, the ingestion of ashes or creation of messes to clean up from the ashes.

An ensuing object of the present invention is that it is childproof by being irremovable by children because the clamping action of this invention limits both the lateral and outward motion of the door when the handles or safety device is pulled from the center or from either end.

A practical object of the present invention is that it is easy and quick to install.

Another corollary object of the present invention is that it is made from materials that are durable, have strength and quality.

An aesthetic object of the present invention is that it blends well and fits with most standard fireplace folding doors that fold or swing open.

Another object of the present invention is that that it fits with most folding door handles of various thicknesses and lengths.

A further object of the present invention is to fit most fireplace doors.

In brief, the method of installing the folding door lock bar is as follows. Center the long bar on top of the fireplace door handles with the exposed holes on the top and bottom. Place the hex screws though the top hole so that they pass through the top bar and the handles. Center the short bar under the fireplace door handles with the exposed holes on the top and bottom. Line up the screw holes in the short bar with the exposed hex screws passing through the handles. Then, tighten the hex screws by hand into the short bar; capturing the handles in between the bars. The hex screws pass through the upper bar without the thread and screws through both threaded portions of the lower tubing. After tightening the hex screws by hand so they are snug, use a hex wrench to completely tighten the screws so they cannot be loosened by a child. It is further recommended to store the hex wrench in a secure place, out of reach of children.

The materials for the invention are as follows:

One 24" Piece of 0.75" aluminum square tubing with wall thickness of 0.0625".

One 14" Piece of 0.75" aluminum square tubing with wall thickness of 0.0625".

Two ¼"-20×2" threaded screws; ⅜" diameter head with 3/16" socket.

One 3/16" standard hex wrench.

To build the invention:

Drill a 9/32" center hole in the 24" aluminum tubing, 7.5" from each end of the tube so that it passes through the entire tube.

Drill a 7/32" center hole in the 14" aluminum tubing, 2.5" from each end of the tube so that it passes through the entire tube. An inside thread must now be made using a ¼"-20 inside thread. The thread must pass through the top and bottom of the 14" tubing.

The current location of the holes fit most standard fireplace doors.

This invention keeps children from opening most fireplace doors that swing or fold open. By clamping the horizontal fireplace door handles with this invention, children cannot open and therefore pinch their fingers or access the fireplace interior causing injuries associated with fireplace interiors. Because the opening action of fireplace doors is normally outward and laterally in a simultaneous motion, the use of an adjustable slide lock that is used on many household doors, including fireplace doors, would only hinder the lateral motion of the doors, and not the outward motion. This outward motion opens the doors enough to create a gap in the door seam (called "seams" if in a bi-fold door), normally large enough to fit a child's finger and possibly hand. If any pressure is placed on any part of the fireplace door while the child's finger or hand is in the seam, possible injuries could occur.

The clamping action of this invention limits both the lateral and outward motion of the door. Because of this, there is little or no movement to the door when the handles or safety device is pulled from the center or from either end.

A primary advantage of the present invention is that it protects children from the hazards associated with opening fireplace doors or other doors that fold or swing with a simple and effective locking device.

Another advantage of the present invention is that it provides a device for childproofing a home adaptable to any folding doorway, such as fireplace doors or appliance areas, to keep children out of places where they should not be.

An additional advantage of the present invention is that it provides a rigid means of preventing movement of folding doors limiting the possibility of pinched fingers and hands.

One more advantage of the present invention is to reduce the possibility of injuries associated with fireplace interiors.

An ensuing advantage of the present invention is that it is childproof.

A practical advantage of the present invention is that it is easy and quick to install.

Another associated advantage of the present invention is that it is made from materials that are durable, have strength and quality.

An aesthetic advantage of the present invention is that it blends well and fits with most standard fireplace folding doors that fold or swing open.

Another advantage of the present invention is that that it fits most folding door handles of various thicknesses and lengths.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
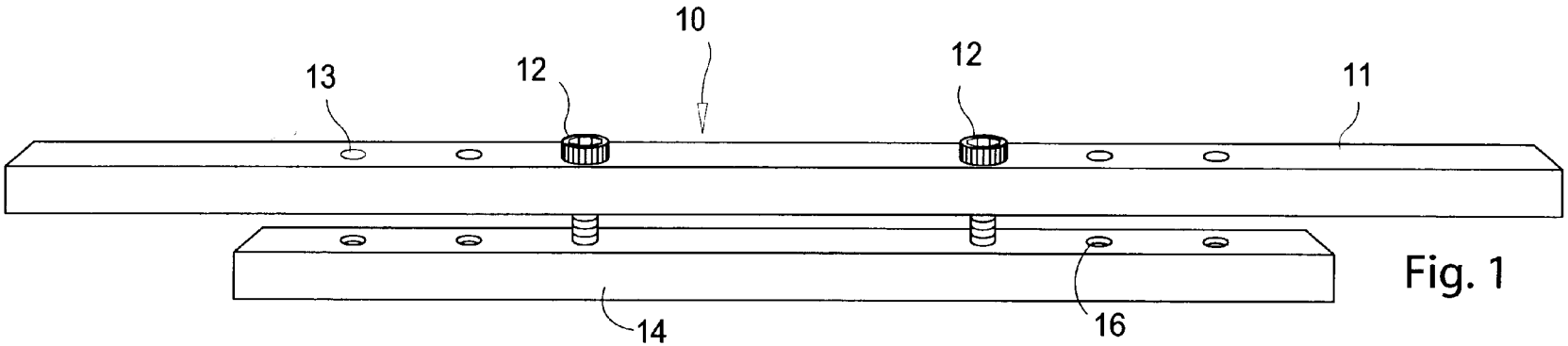
FIG. 1 is a front perspective view of the safety locking bar device showing a long upper bar having holes larger than the hex screws so that the hex screws slide through the fireplace door handles, as in FIG. 4, and then screw into lower bar.
Figure 2:
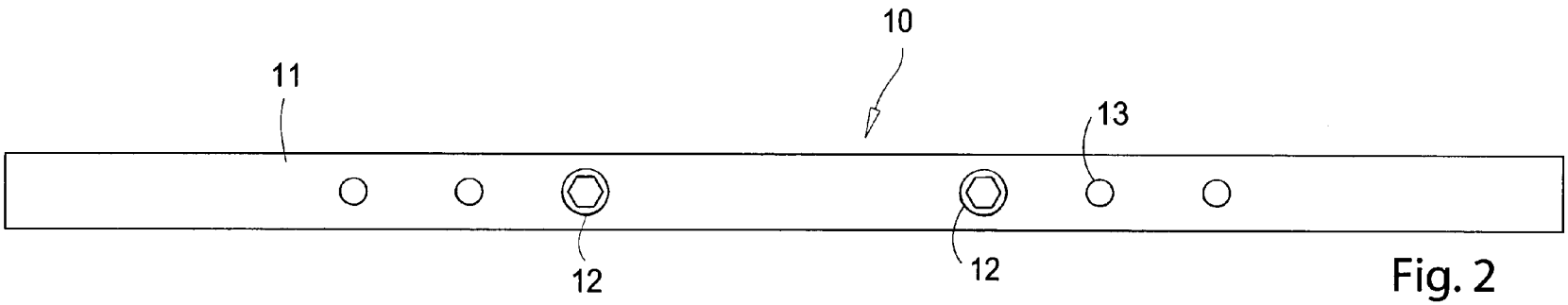
FIG. 2 is a top view of the locking bar device of FIG. 1.

A locking bar device 10 for securing folding doors 20 comprises a top bar 11 formed of rigid elongated material having at least two spaced openings 13 vertically through the top bar 11 and also a bottom bar 14 formed of rigid elongated material having at least two mating spaced openings 16, 15 vertically through the bottom bar 14. There are at least two connecting means, such as a pair of screws 12 or some other connecting means which could be a quick release mechanism not operable by children, for interconnecting the two bars 11, 14 through the at least two spaced openings 13, 16. The at least two spaced openings are positioned so that each of the screws 12 passes through a handle 21 of the folding doors with the screws 12 securely attaching the bars 11, 14 together sandwiching the handles 21 therebetween. The locking bar device 10 is locked in place by the screws 12 through the handles 21.

Figure 4:
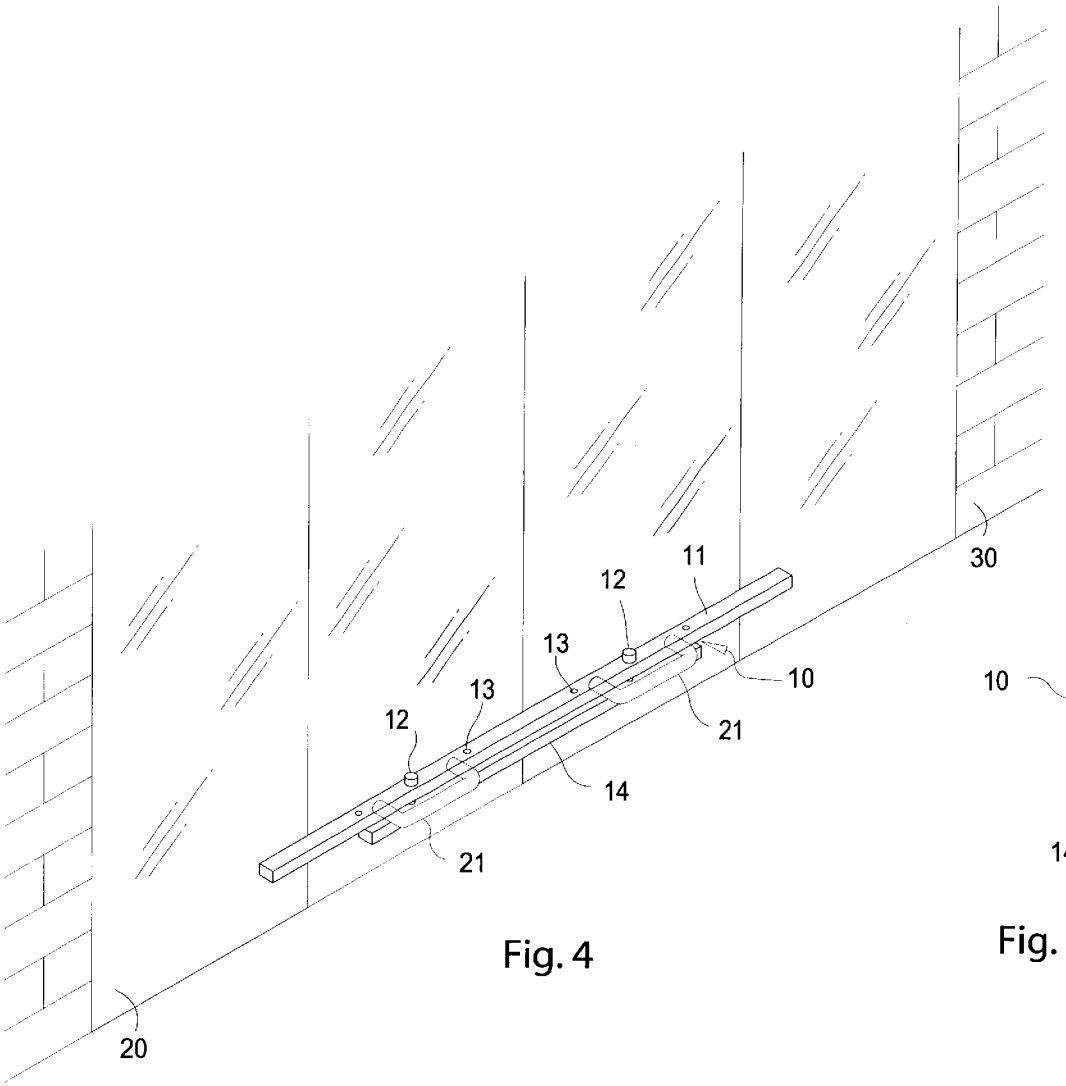
FIG. 4 is a perspective view of the actual invention applied to fireplace door handles.

In FIG. 4, at least one of the bars, the top bar 11 in this case, has a length preferably capable of spanning across all of the seams in the folding doors 20 of the fireplace 30 preventing the opening of the folding doors 20.

In FIGS. 1–4, each of the bars 11, 14 is comprised of a hollow aluminum square tube.

Figure 3:
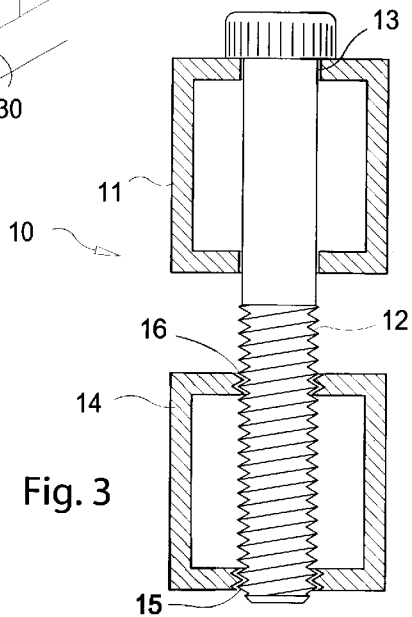
FIG. 3 is a lateral cross-section through the locking bar device of FIG. 1.

In FIGS. 1 and 3, one of the bars, preferably the bottom bar 14, has a threaded opening 16, 15 through each surface thereof and the other of the bars, preferably the top bar 11, has a non-threaded opening 13 through each surface thereof. The pair of screws 12 are capable of passing through the non-threaded openings 13 to threadably engage the threaded openings 16, 15.

In FIG. 3, the pair of screws 12 is comprised of a pair of steel screws with recessed engaging heads requiring an Allen wrench to turn the screws 12, thereby making them childproof.

It is understood that the preceding description is given merely by way of illustration and not in limitation of the invention and that various modifications may be made thereto without departing from the spirit of the invention as claimed.

What is claimed is:

1. A locking bar device for securing folding fireplace doors with protruding horizontal U-shaped handles, the device comprising:

on a folding fireplace door having a pair of protruding horizontal U-shaped handles on the middle folding doors;

a top bar formed of rigid elongated material having at least two spaced openings vertically through the top bar, the two spaced openings being capable of alignment with the pair of horizontal U-shaped handles;

a bottom bar formed of rigid elongated material having at least two mating spaced openings vertically through the bottom bar, the top bar and bottom bar spaced apart by the thickness of the fireplace door handle, the bars being capable of sandwiching the pair of horizontal U-shaped fireplace door handles between the bars;

at least two connecting means for interconnecting the two bars through the at least two spaced openings, the at least two spaced openings being positioned so that each of the at least two connecting means passes through one of the pair of handles of the folding doors, the at least two connecting means securely attaching the bars together sandwiching the handles therebetween, the locking bar device being locked in place by the at least two connecting means through the handles wherein at least one of the bars has a length capable of spanning across a pair of central panels and across a portion of each of the adjacent panels, and maintaining the folding fireplace doors in a flat aligned closed configuration and preventing the lateral and outward movement of the folding doors and the opening of the folding doors without either of the bars contacting a door frame around the folding fireplace doors.

2. The locking bar device of claim 1 wherein each of the bars comprises a hollow aluminum square tube.

3. The locking bar device of claim 2 wherein the at least two connecting means comprise a pair of screws and one of the bars has a threaded opening through a top and bottom surface thereof and the other of the bars has a non-threaded opening through a top and bottom surface thereof, the pair of screws capable of passing through the non-threaded openings and threadably engaging the threaded openings.

4. The locking bar device of claim 3 wherein the pair of screws comprises a pair of steel screws with recessed engaging heads requiring an Allen wrench to turn the screws, thereby making them childproof.

* * * * *